United States Patent [19]

Higginbotham

[11] Patent Number: 4,525,881

[45] Date of Patent: Jul. 2, 1985

[54] HYDROTHERAPY SYSTEM FOR TUBS, SPAS OR POOLS

[75] Inventor: John A. Higginbotham, Maple Grove, Minn.

[73] Assignee: Jope Manufacturing Co. Inc., Minneapolis, Minn.

[21] Appl. No.: 580,379

[22] Filed: Feb. 15, 1984

[51] Int. Cl.[3] ..... A04H 3/18; A61H 33/02; E03C 1/02

[52] U.S. Cl. ..... 4/496; 4/492; 4/541; 4/542; 128/66; 239/428.5

[58] Field of Search ..... 4/542, 492, 541, 543, 4/496, 490; 128/66; 239/428, 428.5

[56] References Cited

U.S. PATENT DOCUMENTS

| | | | |
|---|---|---|---|
| 3,541,616 | 11/1970 | Stricker | 4/542 |
| 3,745,994 | 7/1973 | Kane | 128/66 |
| 3,905,358 | 9/1975 | Jacuzzi | 128/66 |
| 3,985,303 | 10/1976 | Steimle | 128/66 X |
| 4,082,091 | 4/1978 | Kaab | 4/559 X |
| 4,261,347 | 4/1978 | Spencer et al. | 239/428.5 X |
| 4,262,371 | 4/1981 | Berry et al. | 4/492 X |
| 4,422,191 | 12/1983 | Jaworski | 4/496 |

*Primary Examiner*—Henry K. Artis
*Attorney, Agent, or Firm*—James V. Harmon

[57] ABSTRACT

A hydrotherapy system is described in which a movable nozzle with a fluid inlet and outlet pivots about a center point enabling the outlet to be pointed in different directions. A water stream flows toward the passage in the nozzle. The system contains an air inlet and an air outlet passage with a valve chamber communicating between them within the nozzle housing. An air and water check valve moves in the valve chamber to an open or sealed position to allow the passage of air into the chamber but prevents the escape of water.

7 Claims, 10 Drawing Figures

HYDROTHERAPY SYSTEM FOR TUBS, SPAS OR POOLS

FIELD OF THE INVENTION

This invention relates to hydrotherapy units used in pools, spas, tubs and the like for hydromassage or hydrotherapy in which an air induction system is provided for introducing air into a pressurized water stream.

THE PRIOR ART

The increasing use of hydrotherapy or hydromassage jets in tubs, spas and pools in recent years has resulted largely from a greater interest in the recreational and therapeutic use of tubs and spas particularly in the home. Several hydrotherapy jets have been in commercial use to satisfy this increase in demand.

Prior jets have certain difficulties associated with installation and plumbing. This has two causes. First, many prior units cannot be made compact in design, so that the housing protrudes a substantial distance, often six or eight inches, outwardly from the outside surface of the tube after installation. As a result, a large clearance space must be allowed around the outside of the tub. Another cause for problems is the necessity in many prior jets of spacing the water or air feed pipes a substantial distance away from the tub wall at the point where it connects to the jet housing. This requires even more space around the tub for installation. Thus, most prior hydrotherapy jets are not well suited for installation in a small space and installation is time consuming.

Another problem that occurs is an unintended reverse flow or backup of water from the jet out through its air supply hose. Thus, after the water has been turned off and the system is shut down, water present in the jet housing sometimes flows into the air supply hose and can even run out onto the floor. If an attempt is made to prevent this by cutting the rubber air supply hose and inserting a check valve in the hose, there is a considerable added expense and installation costs are increased even further. Moreover, water is free to back up through the hose to the point where the air valve is located. Water standing in such hoses can result in the growth of algae or bacteria and may violate plumbing ordinances in some situations. Moreover, a quantity of water standing in air supply hoses complicates and slows drain-down of the entire system, for example, at the end of the season in outdoor locations or any other time when the system has to be emptied. A further problem is the clearly audible, sometimes annoying, suction noise produced by air entering the air hose that leads to the jet. Thus, one objective is to provide a hydrotherapy jet that is inherently incapable of allowing water to back into air supply pipes or hoses but at the same time will easily aspirate air from the air supply pipe or hose. Another objective is to drastically reduce annoying suction noise while reducing installation time and installation expenses.

In a hydrotherapy jet, water is usually supplied under pressure from a pump driven by an electric motor. An aspiration arrangement is provided within the jet to incorporate air into the water stream. The presence of sufficient air as bubbles of the proper size is important in obtaining an effective body massage as well as the subjective feel of pressure as judged by placing the hand a predetermined distance from the jet. Thus, if the air supply is cut off, the body massage effect and the feel of the pressure against the hand exerted by the emerging water stream drops drastically. In a typical test, the hand is placed in the water 12 inches from the jet nozzle with the jet in normal operation. When the air supply is cut off, the apparent pressure exerted against the hand appears to be only a small fraction, say $\frac{1}{3}$ to $\frac{1}{4}$ of what it was originally. This demonstrates the importance of efficiently introducing air into the water stream to obtain a maximum massaging effect. It is an important object of the invention to prevent the inadvertent back flow of water from the jet out through the air hose without interfering with the free and efficient flow of air into the jet in such quantities sufficient to maximize jet functionality as just described.

SUMMARY OF THE INVENTION

In accordance with the invention, a hydrotherapy jet is provided. The jet includes a housing with a movable nozzle having a passage for water and air extending through it. The nozzle is universally supported within a ball socket located in the housing.

Means is provided at the inlet end of the nozzle for producing a water stream aligned axially with the passage in the nozzle and flowing toward it. An air outlet port is provided in the path of the water stream. Within the jet housing is a one-way air and water valve arranged to permit inward air flow but preventing the reverse flow of water out of the housing into the air hose or pipe. This valve preferably has a movable valve element that is in communication between the air outlet port and the supply pipe or hose. During operation, an air stream passing over the valve and through the air port becomes incorporated into the water stream. This action assures the entrainment of air in the water stream expelled through the nozzle but prevents the backing up of water.

The jet body or housing has a water inlet duct which is preferably positioned parallel to the plane of the tub wall when the jet is installed, i.e., perpendicular to the center axis of the nozzle. Mounted within a ball socket is an eyeball or ball portion of the nozzle. The socket communicates with the water inlet duct so that water will flow from the water inlet duct past the air port and through the nozzle mounted in the socket.

In a preferred form of the invention, the air port and its air inlet duct is located in alignment with the center axis of the nozzle and normal to the tub wall while the water supply pipe and water inlet duct are positioned normal to the air supply duct.

The hydrotherapy jet also includes a nozzle containment chamber that is open to the interior of the tub or spa. At the center of this chamber is located the ball socket which holds the nozzle. The containment chamber encloses the nozzle and provides an outlet for the high velocity jet of water and air expelled through the nozzle. The chamber includes a side wall that is closed upon itself and is spaced radially from the center axis of the nozzle. The side wall terminates in an open rim that serves as a mounting surface adapted to be secured to the wall of the tub or spa. The chamber also includes an end wall in which a ball socket is located. The water inlet duct is parallel to the mounting surface and adjacent to the end wall of the containment chamber.

DETAILED DESCRIPTION

Figure 1:
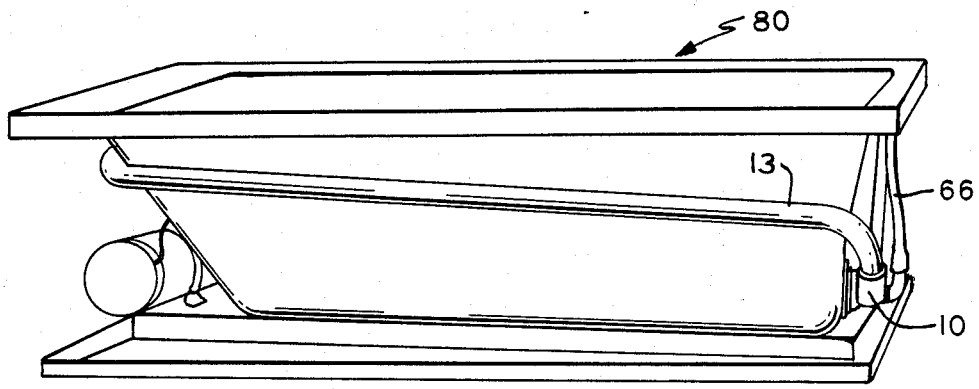
FIG. 1 is a perspective view of the system installed on a tub as seen from one side.
Figure 2:
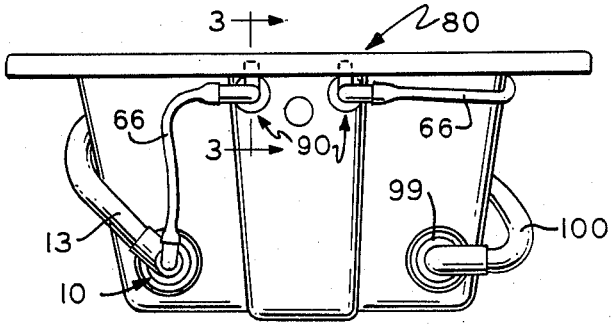
FIG. 2 is an end view of the tub of FIG. 1.
Figure 3:
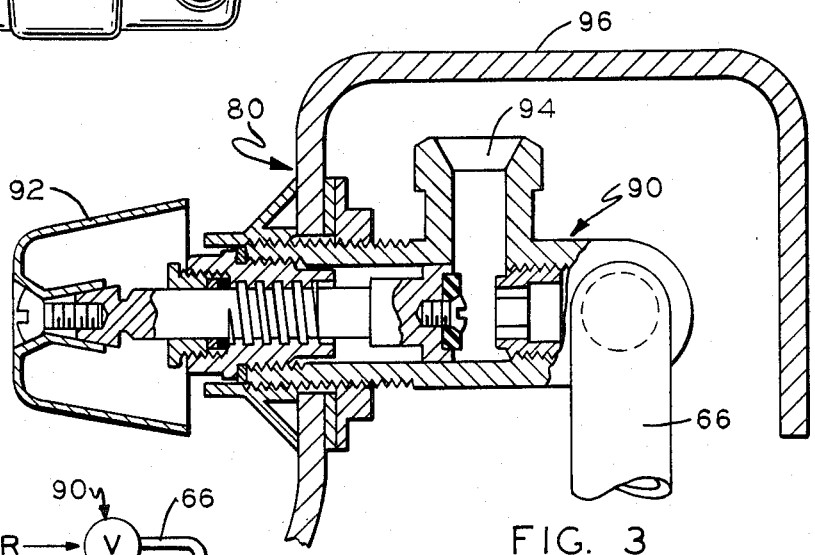
FIG. 3 is a cross-sectional view taken on line 3—3 of FIG. 2 on a larger scale.

As shown in FIGS. 5–9, a hydrotherapy unit is provided including a housing or jet body or housing 10 composed of three major components, a water inlet duct 12, a nozzle containment chamber 18 and an intermediate chamber 22 between them that serves as a water passage allowing water to flow from the water inlet duct 12 to a nozzle 40 mounted within the chamber 18. The hydrotherapy jet can be formed from a variety of materials. Thermoplastic resinous materials such as polyvinyl chloride or ABS resin are preferred.

The water inlet duct 12 includes an upper circular mouth 12*a* and an outer cylindrical surface 12*b*. Into the open end of the mouth 12*a* is slip fitted a section of a plastic water feed pipe 13 (FIGS. 1–4), which is held in place by well-known solvent welding techniques. In the duct 12 is a reduced bore 14 forming a shoulder to locate the end of the supply pipe 13. Adjacent water inlet duct 12 is a cylindrical air inlet duct 15 which also serves as a valve chamber that has a protruding mouth at 17 having a circular outer surface 17*a* for the attachment of an air supply fitting 60.

Figure 8:
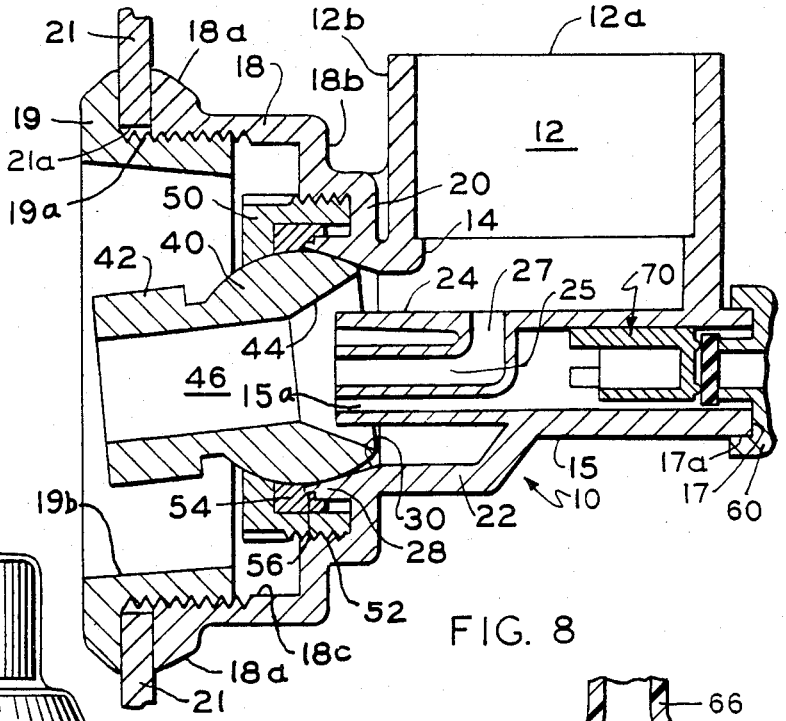
FIG. 8 is a vertical sectional view of the jet taken on line 8—8 of FIG. 1 with the air and water valve in the closed position.
Figure 10:
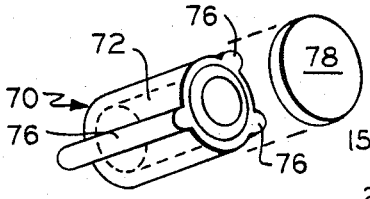
FIG. 10 is a perspective view of the movable valve element.
Figure 9:
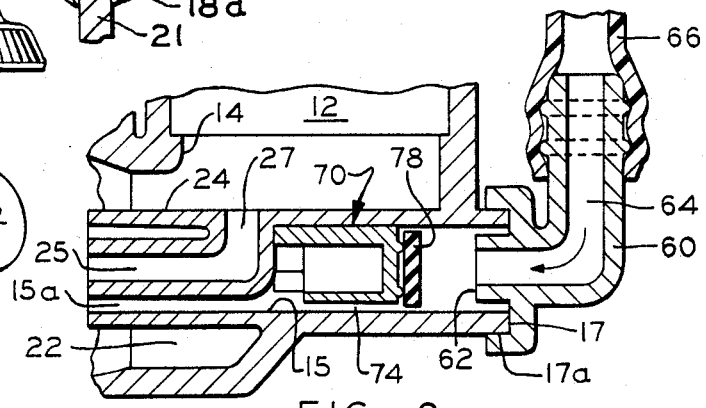
FIG. 9 is a partial view of the inlet ducts showing the operation of the valve in the open position.

Refer now to FIGS. 8 and 9. Within the valve chamber 15 is a cup-shaped cylindrical valve element 70 having a cross-section considerably less in diameter than the diameter of the chamber 15 so that its side wall 72 is spaced inwardly from the side wall of chamber 15 with an annular air space 74 between them. The valve element is suspended for sliding motion within the chamber by three longitudinally extending circumferentially spaced apart guide bars 76 that are integral with the valve element itself. A rubber sealing disk 78 is bonded to the end of the valve element 70 furthest from the nozzle 40 and is positioned to abut at times (FIG. 8) against a circular valve seat 62 aligned with the axis of chamber 15 that projects from the fitting 60. The fitting includes an air passage 64 that communicates through the center of the seat 62 with the air inlet and valve chamber 15. During operation with water flowing under pressure into the nozzle body through pipe 13, the flow of water will aspirate or otherwise induce the flow of air in through a supply hose 66 and passage 64 through the opening in the center of valve seat 62 forcing the valve 70 toward the open position of FIG. 9 as air passing around it through the annular space 74 and the chamber 15. After the water is turned off, even the slightest flow of water from the tub will force the valve element 70 toward the right sealing pad 78 against the seat 62 thereby preventing unintended back-flow of water out of the tub into the air supply lines. The hydrostatic pressure of water in the tub is enough to move the valve 70 in this way preventing water from standing in hose 66 which if it occurred could form a breeding ground for bacteria or algae and may violate plumbing ordinances. It will be seen that the valve 70 is self-contained within the jet body 10 and no portion of the hose 66 can become filled with water.

The nozzle containment chamber 18 includes a side wall 18*c* that is closed upon itself and in this case is cylindrical in shape. Chamber 18 has a radially projecting circular rim that serves as a tub mounting flange 18*a* including an outer flat surface 16 which engages the outer surface of tub wall 21. The tub wall 21 is provided with a bored opening through which extends a retaining collar 19 that is screwthreaded at 19*a* into the cylindrical wall 18*c* to hold the jet housing 10 in place on the tub 21 as shown in FIG. 8. A suitable adhesive or sealing gasket (not shown) can be used between the tub wall and the hydrotherapy unit as desired. The collar 19 is ring-shaped and includes a large central opening 19*b* for the nozzle 40 to be described below. Chamber 18 has a flat end wall 18*b* with an axial projection 20 (FIGS. 6–8) for a ball retaining ring to be described below.

Figure 6:
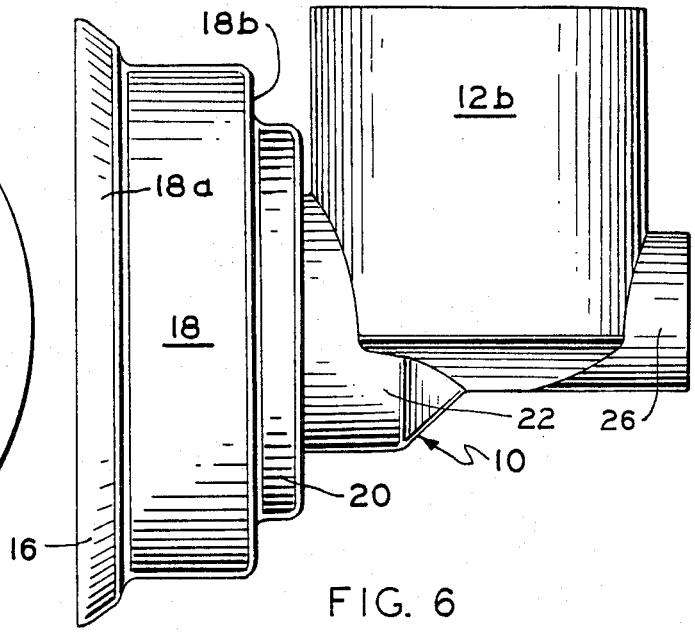
FIG. 6 is a side elevational view of the jet of FIG. 1.

The intermediate chamber 22 communicates at its left end as seen in FIGS. 6 and 8 with the nozzle 40 to be described below and its other end with the interior of the water duct 12. In this way, water passes from the inlet duct 12 to the nozzle 40.

Centered within the chamber 22 are two concentric tubes including an outer tube 24 and an inner tube 25 spaced inwardly therefrom to form an annular air duct 15*a* between them terminating in an air outlet port. The air duct 15*a* communicates wih the air inlet 15 that also serves as a valve chamber. It can be seen that the two concentric ducts 24 and 25 extend from their free ends away from the nozzle 40 toward the right and are integral with the walls of the housing of the hydrotherapy jet 10.

Figure 7:
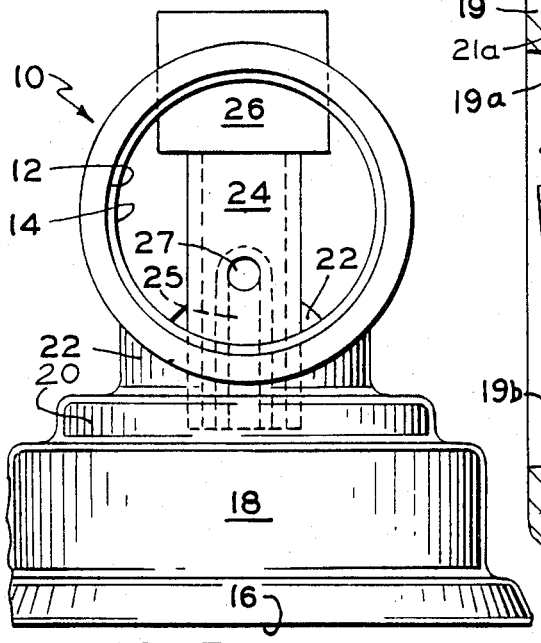
FIG. 7 is a top view of the jet.

As seen in FIGS. 7–9, the inner pipe 25 bends upwardly at the end thereof most distant from the nozzle 40 and communicates through an opening 27 with the interior of the water inlet duct 12. In this way, the water from the duct 12 flows through the opening 27 into pipe 25 to form a central water stream. While the hole 27 can be positioned to one side, it is preferred that it point in the direction of the stream of water entering duct 12. This helps to funnel water into pipe 25.

Centrally located within the end wall 18*b* of the nozzle chamber 18 is a generally conical ball socket 30 tapered outwardly in the direction of the nozzle containment chamber 18 and having its smallest cross-sectional diameter at the junction with the chamber 22. Universally supported within the socket 30 is a nozzle having an eyeball 40 of spherical configuration with an outward extension 42 at its free end, i.e., the left end as seen in FIG. 8 which serves as a positioning knob, and a central passage 46 of cylindrical shape having an inlet at its right end in the figures communicating with the water inlet duct 12. The inlet can comprise an inlet cone or funnel 44 to help guide the flow of the fluid into passage 46. At the other end of the passage 46 is an outlet 48 which if desired may have a beveled edge defining a conical outlet opening 48.

The nozzle or eyeball 40 is held for universal swiveling motion within the socket 30 by means of a ball retaining ring 50 that is screwthreaded into the rearward projection 20 of the rear wall 18*b* of chamber 18 as shown at 52. Between the eyeball 40 and the socket 30 is a sealing gasket 54 that is held in place by the retaining ring 50. When ring 50 is tightened, the inner surface of the gasket 54 is forced onto a relatively sharp circular edge 56 at the large end of the socket 30 to help assure a good seal.

It will be noted that the nozzle 40 is positioned at the center of chamber 18 and has a center point that is in alignment with the central axis of tubes 24 and 25 and the annular air port 15*a* between them. The nozzle itself has a center axis which is in alignment with the axis of tubes 24, 25 when the nozzle itself is straight or centered, i.e., aligned with the center axis of the chamber 18. During use, it will be apparent that the nozzle 40 can be swiveled in any direction desired. In FIG. 8, it is shown at an inclined position in which it will direct water downwardly at a small angle. When the axis of the nozzle 40 is referred to herein, it will have reference to the centered position. It will be noted that the free outlet ends of tubes 24 and 25, i.e., their left ends as shown in FIGS. 8 and 9, terminate in alignment with each other and are spaced from the nozzle 40. In the embodiment shown tubes 24 and 25 and port 15*a* project a slight distance inside the nozzle 40. The inlet or cone 44 is larger in diameter than the free end of the tube 24 thereby defining an annular mouth 45 between the outside surface of tube 24 and the inlet 44 for conducting a portion of the water entering through duct 12 into the inlet 44 of the nozzle 40. This difference in size permits the ball 40 to be swiveled in all directions without striking the tube 24.

Figure 4:
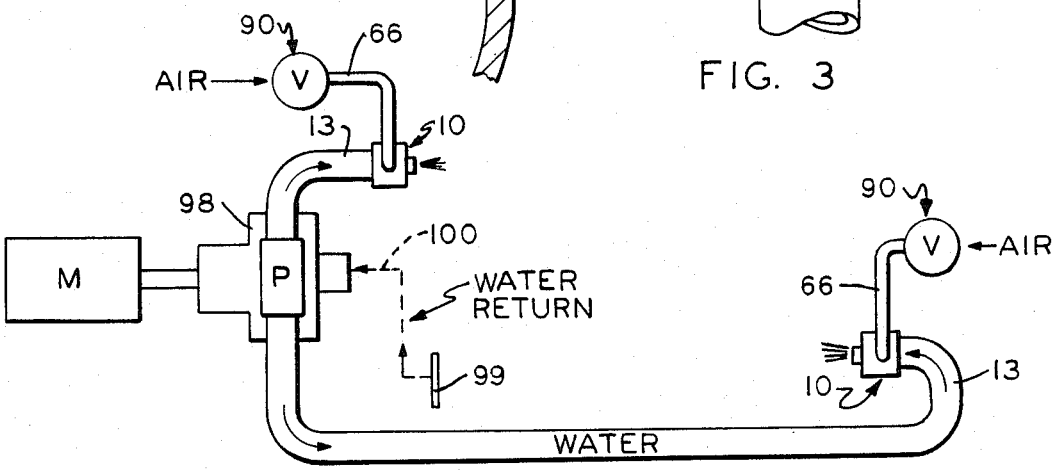
FIG. 4 is a schematic diagram of the water circuit.
Figure 5:
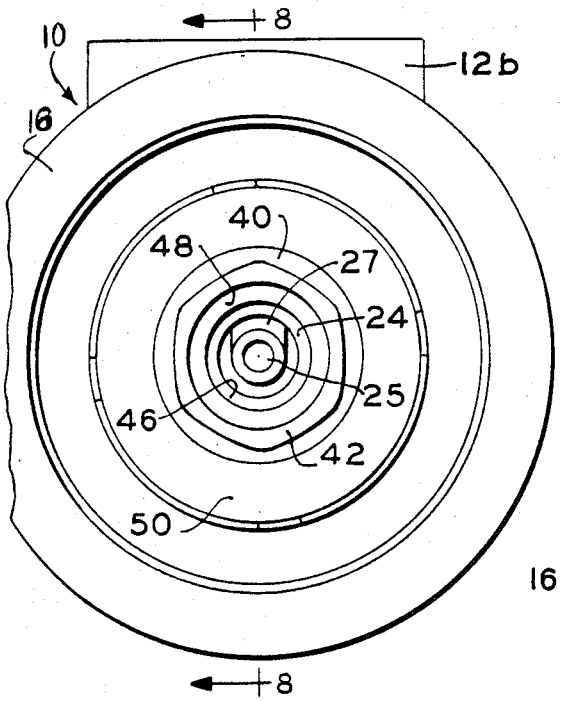
FIG. 5 is a front elevational view of a hydrotherapy jet in accordance with the invention.

FIGS. 1–4 show a tub in which two jets 10 are mounted each of which is connected to a high pressure water supply pipe 13 and an air supply hose 66. The inlet or upper end of each hose 66 is connected to a shut-off valve 90 of suitable known construction having a handle 92 inside the tub and an air inlet port 94 positioned on the outside of the tub under the tub lip 96. Valves 90 enable the user to adjust the jet pressure conveniently and the location of the ports 94 beneath the lip 96 was found particularly effective in reducing the annoying hissing sound of air entering the system. In FIG. 4 a motor driven pump 98 is shown connected to two outlet or supply pipes 13. Water is taken in through a water return fitting 99 and pipe 100.

To install the hydrotherapy jet, a round opening 21*a* of the appropriate size is first bored in the wall 21 of the tub, pool or spa 80 to receive the collar 19. The unit is then placed in the opening 21*a* as shown in FIG. 8 and the water inlet 12 is directed upwardly, downwardly or to one side, i.e., at any angle with respect to the center axis of the chamber 18 which is the same as the axis of the opening in the tub 21. Because duct 12 can be pointed in any direction extending radially of the axis of chamber 18 and the hole 21*a*, the plumbing of water pipes 13 as well as air pipes (not shown) is substantially simplified. It will also be seen that no elbow or T fitting is required to attach the water supply pipe 13 into the water supply duct 12. When the direction of the water inlet has been selected and set, the collar 19 is tightened to securely retain the unit in place within the opening 21*a*. It will be seen that as the unit is rotated about the axis of the tub opening to a selected position, the mouth 26 of the air supply duct 15 remains in the same place. This is because the mouth of the air supply duct is aligned with the axis of the chamber 18 and opening 21*a*. The air supply hose 66 is attached to the fitting 60. It can also be seen from FIGS. 1 and 2 that the water inlet pipe 13 will be located relatively close to the tub wall 21 because the hydrotherapy jet in accordance with the invention is made highly compact through compression or foreshortening, i.e., by placing duct 12 adjacent the nozzle chamber 18, and by positioning the axis of the inlet duct 12 at right angles to axis of the tub hole in alignment with the rear wall 18*b* of the nozzle chamber 18 and perpendicular to the axis of the nozzle 40. Accordingly, the protrusion of the jet from the outer wall of the tub is minimized. The overall depth may be only about 3½ or 4 inches allowing installation in a minimum of space and enabling the tubs to be used in locations where prior tubs will not fit. Shipping cartons are also reduced in size and freight costs are lowered.

After the unit is installed in the manner described and the supply pipes connected for water and air, motor M is turned on and water under pressure is supplied to the inlet 12.

The pump 98 is driven by an electric motor which is typically about 0.5 for a single jet to 3 H.P. (multiple jet) providing a jet velocity of about 50 feet per second and a line pressure of about 15–20 psi. As the water flows under pressure from pipe 13 into the inlet 12, it is directed toward the passage 22 in the nozzle around the outside of tube 24. It then flows at high speed through the mouth 45 between the free end of the tube 24 and the inlet cone 44 of the nozzle 40. A portion enters the opening 27 in pipe 25 and is expelled as a fast moving stream or jet into the passage within the nozzle 40. Accordingly, two water streams exist concentric to one another and with air provided through the port at the end of annular duct 15*a* they are separated by an intermediate annular lamina of air. The inner surface of the outer water stream as well as the outer surface of the inner water stream are both exposed to the intermediate annular lamina of air entering from chamber 15 through port 15*a*. This assists in efficient induction of air into the combined water stream in the form of small bubbles about 1/16" to ⅛" in diameter. Not long after the streams pass the free end of the concentric ducts 24, 25 they intersect, striking one another along a circular impact zone. As the two streams collide forcefully in the presence of the intermediate lamina of air, they become almost explosively disrupted to vigorously incorporate air from the annular air lamina between them. Valve 70 allows air to flow easily and freely in from supply line 66 but prevents the escape of water from the valve housing 10. The nozzle can be swiveled manually by grasping the extension 42 at its free end to any desired position up, down or to the side to direct the stream where desired.

While the invention has been described by way of example, numerous variations will be apparent to those skilled in the art within the scope of the appended claims once the principles of the invention are understood.

What is claimed is:

1. A hydrotherapy jet comprising a housing, a movable nozzle having a passage therethrough with a fluid inlet and a fluid outlet at opposite ends of the passage, the movable nozzle being supported in the housing for movement about a center point to enable the outlet to be pointed in different directions, means at the inlet end of the nozzle defining a water stream flowing toward the passage in the nozzle, means at the inlet end of the nozzle defining an air outlet port, an air inlet passage, a valve chamber communicating between the air inlet passage and the air outlet port, an air and water check valve in the valve chamber adapted to move therein between a seated sealing position preventing the escape of water therethrough from the nozzle and an open position allowing the passage of air into the chamber from the air inlet passage and out through the outlet port in the nozzle.

2. The hydrotherapy jet of claim 1 wherein the check valve comprises a valve body spaced from the interior of the valve chamber and a plurality of guide members are provided on the check valve to hold the check valve in spaced relationship from the walls of the valve chamber and to support the check valve slideably within the valve chamber for movement to an open position at one end and to a closed position wherein the check valve is sealed against a valve seat communicating with the air inlet passage.

3. The hydrotherapy jet of claim 2 wherein the check valve has a rubber gasket secured thereto in position to seal the valve seat when the check valve is in a closed position by preventing the escape of water from the hydrotherapy jet through the air inlet passage while permitting air to flow freely through the check valve into the nozzle.

4. The hydrotherapy jet of claim 1 wherein the valve chamber comprises a cylindrical chamber aligned axially with the nozzle and the check valve comprises a cylindrical valve body slideably mounted therein along the axis of the cylindrical valve chamber, said check valve includes a plurality of longitudinally extending, circumferentially spaced apart guide bars distributed on the peripheral cylindrical surface thereof and being spaced apart from one another, said check valve is of a smaller cross-sectional size than the diameter of the cylindrical valve chamber whereby an annular air flow passage is provided around the check valve through the valve chamber and a valve seat is provided at one end of the chamber communicating with the air inlet passage and positioned and arranged to be sealed by the check valve when the check valve is moved in a direction away from the jet nozzle whereby the pressure of water within the hydrotherapy jet will be adapted to force the check valve to a sealed position against the seat except when water is pumped into the nozzle to define the water stream flowing toward the passage in the nozzle, thereby preventing the flow of water past the check valve into the air inlet passage.

5. The hydrotherapy jet of claim 4 wherein an air inlet fitting is mounted upon the opposite end of the valve chamber from the end thereof closest to the jet nozzle and said fitting has an air inlet passage extending therethrough in a circular valve seat aligned with a central longitudinal axis of the valve chamber and communicating with the air flow passage extending through the fitting.

6. The hydrotherapy jet of claim 1 wherein the jet is mounted upon a tub or spa having a laterally extending peripheral lip at the upper edge thereof, an air shut-off valve is mounted on the wall of the tub with a handle accessible from the inside of the tub and the shut-off nozzle is provided with an air opening positioned on the outside surface of the tub beneath the lip and a hose or pipe communicates between the shut-off valve and the air inlet passage whereby the user can control the operation of the hydrotherapy jet from within the tub, and the location of the air inlet below the lip of the tub helps to silence the sound of the air entering the shut-off valve.

7. The hydrotherapy jet of claim 4 wherein the jet is mounted upon a tub or spa having a laterally extending peripheral lip at the upper edge thereof, an air shut-off valve is mounted on the wall of the tub with a handle accessible from the inside of the tub and the shut-off nozzle is provided with an air opening positioned on the outside surface of the tub beneath the lip and a hose or pipe communicates between the shut-off valve and the air inlet passage whereby the user can control the operation of the hydrotherapy jet from within the tub, and the location of the air inlet below the lip of the tub helps to silence the sound of the air entering the shut-off valve.

* * * * *